United States Patent [19]

Babuin et al.

[11] Patent Number: 4,580,421

[45] Date of Patent: Apr. 8, 1986

[54] LAUNDRY WASHING MACHINE

[75] Inventors: Piero Babuin; Giuseppe Frucco; Piero Durazzani, all of Pordenone, Italy

[73] Assignee: Industri Zanussi S.p.A., Pordenone, Italy

[21] Appl. No.: 677,302

[22] Filed: Dec. 3, 1984

[30] Foreign Application Priority Data

Dec. 6, 1983 [IT] Italy ..... 45734 A/83

[51] Int. Cl.[4] ..... D06F 33/02

[52] U.S. Cl. ..... 68/12 R; 68/16; 68/18 F; 68/58; 68/207

[58] Field of Search ..... 68/12 R, 207, 16, 58, 68/18 F

[56] References Cited

U.S. PATENT DOCUMENTS

| | | | |
|---|---|---|---|
| 2,279,656 | 4/1942 | Chamberlin et al. | 68/16 |
| 2,892,334 | 6/1959 | Gray, Jr. | 68/12 R |
| 2,914,935 | 12/1959 | Sampsel | 68/12 R |
| 3,197,980 | 8/1965 | Marple | 68/12 R |
| 3,220,228 | 11/1965 | Low | 68/12 R |

FOREIGN PATENT DOCUMENTS

| | | | |
|---|---|---|---|
| 234908 | 5/1911 | Fed. Rep. of Germany . | |
| 1410985 | 11/1968 | Fed. Rep. of Germany . | |
| 2245532 | 3/1974 | Fed. Rep. of Germany . | |
| 982765 | 3/1949 | France . | |
| 1126858 | 6/1955 | France . | |
| 2066878 | 8/1971 | France . | |
| 2525645 | 10/1983 | France . | |
| 10577 | 1/1979 | Japan | 68/207 |
| 152358 | 11/1979 | Japan | 68/12 R |
| 954037 | 4/1964 | United Kingdom | 68/207 |

*Primary Examiner*—Philip R. Coe

*Attorney, Agent, or Firm*—Wenderoth, Lind & Ponack

[57] ABSTRACT

A laundry washing machine includes a washing tub, a washing drum for containing laundry to be washed, a collector for collecting washing liquid, and a recirculation pump connected to the collector and to the tub for recirculating the washing liquid from the collector to the tub and to spray it onto the laundry. The collector has therein at least one heating element and a thermostatic sensor for heating the washing liquid and for thermostatically controlling the temperature thereof, respectively. Level sensors and controls are provided for carrying out "intense" and "gentle" laundering programs for washing the laundry in a conventional manner, and with further sensors and controls for carrying out "intense" laundering programs at reduced filling levels of the washing liquid within the tub by repeatedly recirculating the liquid to the tub.

7 Claims, 3 Drawing Figures

LAUNDRY WASHING MACHINE

BACKGROUND OF THE INVENTION

The present invention relates to a laundry washing machine capable of efficiently laundering laundry of different types with varying charges of laundry in the washing drum and varying levels of the laundering fluid in the washing tub.

At present, conventional laundry washing machines offer the possibility of carrying out "intense" and "gentle" laundry washing programs suitable respectively for laundering cotton fabrics and/or synthetic fabrics which are resistant to elevated temperatures of the laundering liquid, and for laundering delicate fabrics and/or woolens. In particular, the "intense" laundering programs comprise a series of pre-laundering, main laundering, rinsing and centrifuging or spinning operations of conventional type which may be carried out with different levels of laundering liquid in the washing tub and by heating this laundering liquid to varying temperatures depending on the degree to which the laundry is solied. While on the one hand such "intense" laundering programs permit laundry of different types to be efficiently laundered, their use on the other hand involves a relatively high consumption of electric energy, water and detergents, so that they are economically disadvantageous.

Certain known types of laundry washing machines are designed for carrying out particular types of "intense" laundering programs so as to limit the consumption of the above enumerated resources. By contrast to the above described programs, these additional "intense" laundering programs can be carried out at lower temperatures of the laundering bath (usually limited to a maximum of about 60° C.) while allowing the washing drum of the machine to be loaded with the maximum charge of laundry, or selectively with a reduced level of washing liquid in the washing tub of the machine, in which case the drum must be loaded with a reduced charge of laundry, usually up to about half of the possible maximum charge.

In both of the described alternatives, these additional "intense" laundering programs are carried out by increasing the overall duration of the alternating rotation of the drum, so as to subject the laundry to a mechanical laundering action over an extended period of time. As a result, these particular "intense" laundering programs make it possible to reduce the consumption of electric energy and water as compared to conventional programs. On the other hand, however, the employment of these programs results in a somewhat less efficient washing of the laundry and does not permit the laundry to be sterilized.

The "gentle" laundering programs provided for in known washing machines likewise involve a succession of pre-laundering, laundering, rinsing and centrifuging or spinning operations to be carried out in the known manner with different levels of washing liquid in the tub, such liquid being heated to lower temperatures that in the case of the above discussed "intense" laundering programs, so as to ensure efficient laundering of the laundry without the danger of damage thereto. In this case, however, there are no provisions for any special "gentle" laundering programs which would permit the consumption of energy and other resources to be reduced as in the above discussed situation, since the washing of the laundry is already carried out at relatively low temperatures of the washing liquid, such that the consumption of electric energy is substantially limited in any case.

SUMMARY OF THE INVENTION

It is an object of the present invention to eliminate the shortcomings and drawbacks of conventional laundry washing machines by providing a novel laundry washing machine adapted to carry out "intense" laundering programs for washing and sterilizing laundry soiled to varying degrees, as well as conventional "gentle" laundering programs.

In particular, the laundry washing machine of the invention provides the possibility of carrying out conventional "intense" laundering programs for washing very soiled laundry, as well as "intense" laundering programs involving a reduced consumption of electric energy, water and detergent for washing less soiled laundry, at varying charges of such laundry being loaded into the washing drum.

To this effect, the laundry washing machine according to the invention is provided with a recirculation system for the washing liquid contained in the washing tub, such system comprising a special recirculation pump the inlet and outlet of which are connected respectively to the discharge outlet conduit of the tub and to a recirculation conduit itself connected to the tub at a higher level than the discharge outlet conduit.

As an alternative, the function of the recirculation pump may be carried out by the discharge pump itself by operating it in opposite directions of rotation for discharging or for recirculating the washing liquid.

The same results may also be obtained in a different manner, such as by combining the discharge pump with a deviation solenoid valve operable to selectively connect the pump to the discharge conduit or to the recirculation conduit.

According to the invention, the conventional "intense" laundering programs are carried out by the washing machine of the invention without recirculation of the washing liquid in the tub, i.e. without operating the recirculation pump for the full duration of these programs.

On the other hand, the "intense" laundering programs with reduced consumption are carried out by the application of the per se known principle of introducing a limited amount of washing liquid to the washing tub, so that the laundry is just about soaked therein, the washing liquid being heated to a predetermined temperature and successively recirculated through the washing tub by operating the described recirculation pump during predetermined phases of the washing cycle. In this case, the treatment of the laundry is carried out by operating the washing drum of the machine at the normal laundering speed and with alternating directions of rotation for prolonged periods of time, and successively at an increased spinning speed in only one direction of rotation for short periods of time.

For ensuring efficient recirculation of the washing liquid to the drum, the laundry washing machine is additionally provided with a suitable washing liquid collector associated with the discharge conduit of the tub, and with relatively fine mesh filters for retaining impurities entrained by the washing liquid to be recirculated to the tub so as to prevent such impurities from being again deposited on the laundry.

These and other objects are attained according to the invention by the provision of a laundry washing machine including a washing tub, a drum rotatably mounted in the tub, a washing liquid collector located at a position below the tub and communicating therewith, and an electric recirculation pump the inlet and outlet of which are connected respectively to the collector and the tub for repeatedly recirculating the washing liquid from the collector to the tub. The electric pump is connected to the electric circuit of the machine which additionally includes means for heating the washing liquid as well as means for controlling respectively the tub charging level and the temperature to which the washing liquid is heated. The means for controlling the charging level comprise first and second groups of pressostats or similar level sensing devices calibrated in such a manner that the pressostats of the first group are effective to control a charging level which is lower than that controlled by those of the second group. Actuating means are provided for selectively connecting the heating means and the temperature control means in series with respective pressostats of the first group, parallel to the electric recirculation pump, or with respective pressostats of the second group.

BRIEF DESCRIPTION OF THE DRAWINGS

Other objects, features and advantages of the invention will become more clearly evident from the following description, given by way of a non-limiting example, with reference to the accompanying drawings, wherein.

DETAILED DESCRIPTION OF THE INVENTION

Figure 1:
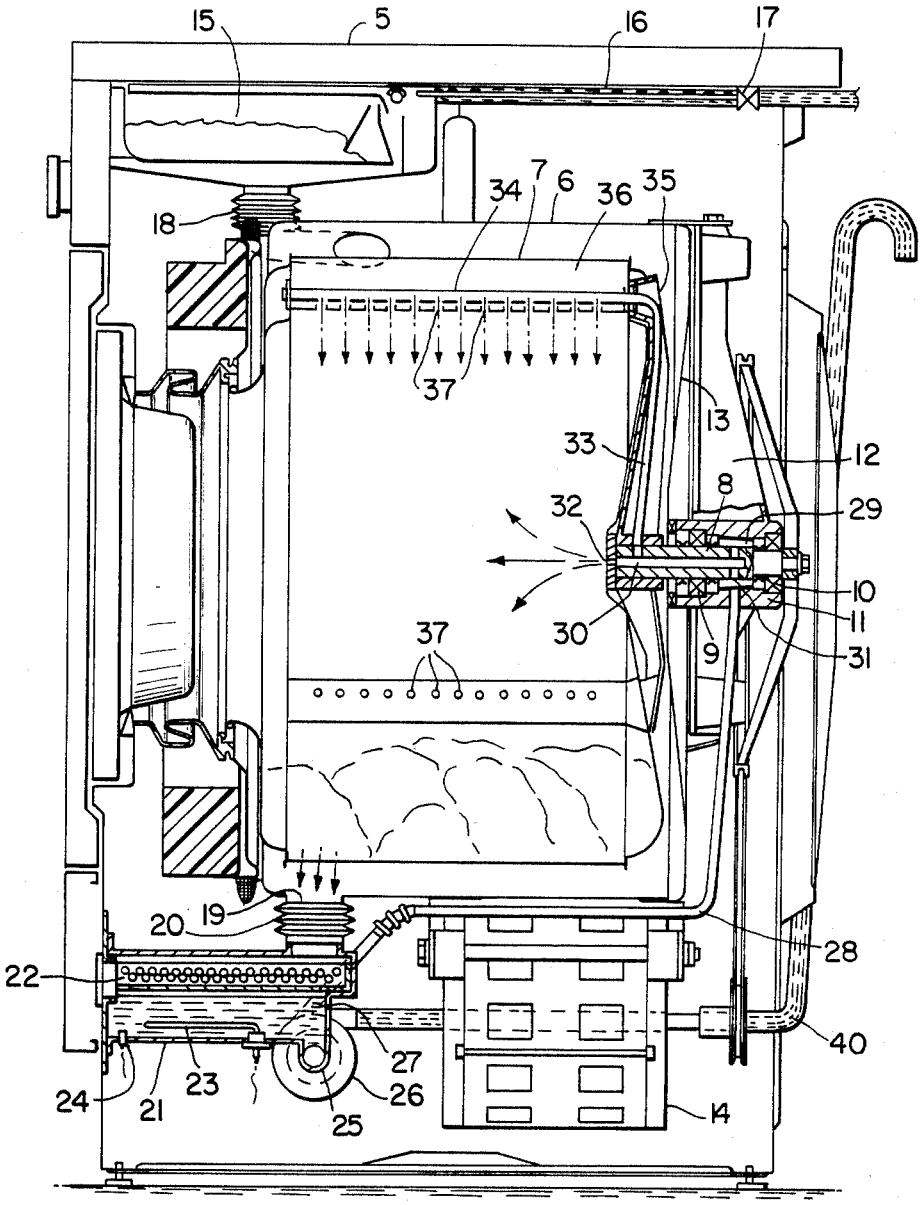
FIG. 1 is a diagrammatic and partially sectioned side view of a laundry washing machine according to one embodiment of the invention.

With reference to FIG. 1, a laundry washing machine shown therein comprises a housing 5, a washing tub 6 supported within housing 5 in a per se known manner, and a rum 7 provided with a shaft 8 mounted in bearings 9 and 10 in a hub member 11 of a support bracket 12 secured to outer rear wall 13 of tub 6. Shaft 8 is adapted to be rotated by an electric motor 14 of the machine in a conventional manner.

Disposed within the upper portion of the machine is a container 15 for detergents to be used during a washing cycle, connected to a water supply circuit by means of a conduit 16 and a solenoid valve 17 and provided with a flexible conduit 18 connected to tub 6 for the introduction thereinto of water and detergents.

The lower portion of tub 6 is formed with an outlet opening 19 connected by a flexible conduit 20 to a collector 21 provided for collecting therein washing liquid issuing or discharged from tub 6. Collector 21 is designed to accommodate a fine mesh sieve 22 or any other suitable type of a conventional filter element removably inserted into collector 21, in addition to at least one heater element 23 and a thermostat sensor 24, both of which are connected to the electric circuit of the machine in a manner to be described and provided respectively for heating the washing liquid and for controlling the temperature thereof. Filter 22 is disposed in collector 21 in such a manner that the washing liquid issuing from tub 6 has to pass therethrough, so as to retain any particulate impurities entrained by the liquid during the execution of a laundering cycle.

The lower portion of collector 21 is connected to the suction inlet 25 of a recirculation pump 26 coaxially aligned with the discharge pump (not shown) of the machine and having an outlet 27 connected to the first end of a fixed washing liquid recirculation conduit 28. Conduit 28 is mounted within the machine exteriorly of tub 6 and has its other end connected to a chamber 29 formed in hub portion 11 of mounting bracket 12 between bearings 9 and 10. Chamber 29 communicates with an axial bore 30 formed in shaft 8 of drum 7 through a number of radial passages 31. Axial bore 30 communicates with the interior of drum 7 through a further bore 32 coaxially aligned with bore 30 and of smaller cross-sectional area, and through a number of radial passages 33 extending along arms 35 of support bracket 12 and connected at their radially outer ends to respective axially extending conduits 34 disposed within agitating ribs 36 of drum 7 and each formed with an aligned row of perforations 37.

Figure 2:
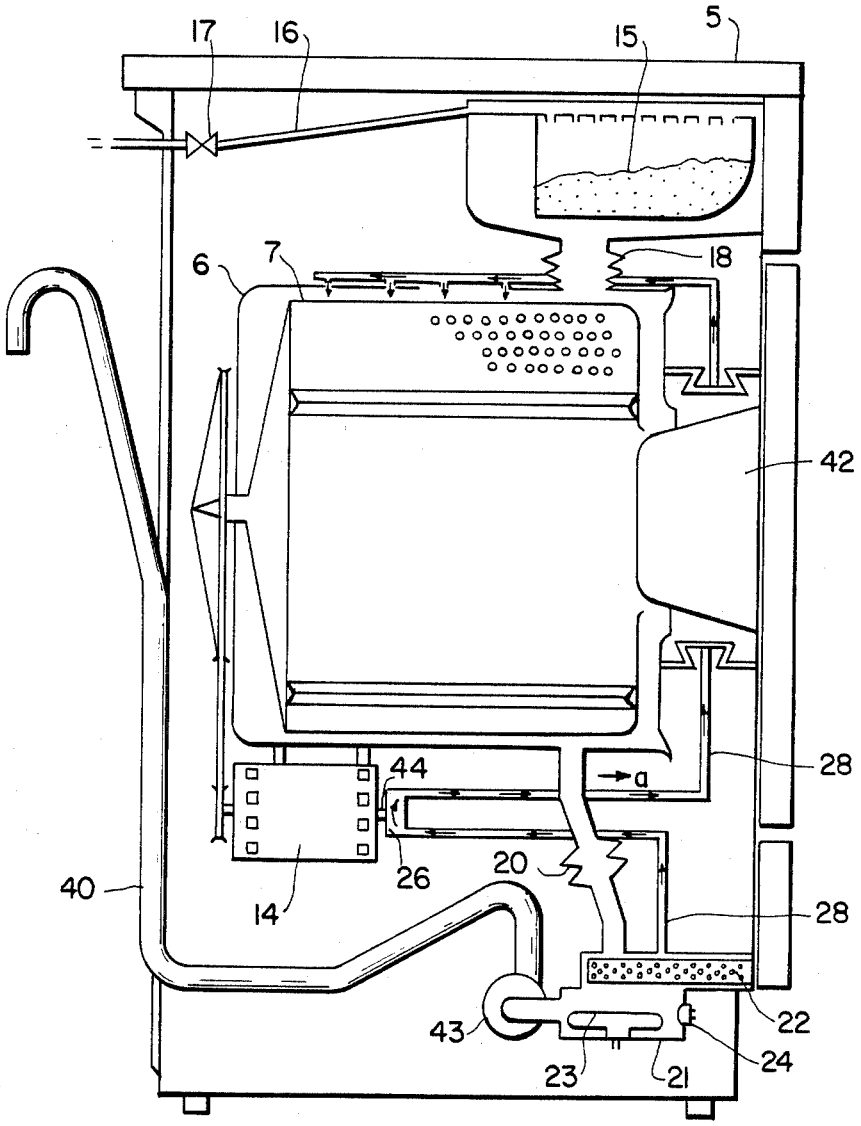
FIG. 2 is a diagrammatic side view of a laundry washing machine according to another embodiment of the invention.

As an alternative to the embodiment described, conduit 28 may also be connected to the upper portion of tub 6, as shown in FIG. 2, or may end adjacent a front window 42 of the machine or at any other suitable location.

By actuating recirculation pump 26 while maintaining the discharge pump in an inoperative state, the described laundery washing machine thus is capable of reusing the washing liquid collected in collector 21 and heated by heater element 23 by returning it to tub 6 via conduit 28, chamber 29 and bores 30 and 32 and additionally via conduits 33 and 34 and the perforations 37 thereof in the embodiment of FIG. 1, or solely via conduits 28 as in the embodiment of FIG. 2. By actuating the discharge pump while maintaining recirculation pump 26 in an operative state, the washing liquid may be discharged from collector 21 via a discharge hose 40 provided for this purpose.

The machine according to the invention also provides the possibility of using the discharge pump alone for recirculating the washing liquid or for discharing it from the machine. In this case the pump may be provided with a single inlet and two outlets connected respectively to the recirculation conduit and to the discharge conduit, the rotor of the pump being adapted to be rotated in opposite directions to either recirculate the washing liquid or to discharge it from the machine. It is also possible to employ a conventional discharge pump in combination with a two-way solenoid valve adapted to communicate the outlet of the pump selectively to the recirculation conduit or to the discharge conduit.

A further possible embodiment of the laundry washing machine according to the invention is diagrammatically shown in FIG. 2. In this case there are provided two independent and separate pumps 26 and 43 for recirculating the washing liquid and for discharging it, respectively. In particular, recirculating pump 26 is not provided, as in the embodiment described above, with its own actuating motor, but is directly coupled to a shaft 44 of main drive motor 14 of the machine, so that rotation thereof in a predetermined direction results in recirculating pump 26 being driven to recirculate the washing liquid from collector 21 to tub 6 in the direction of arrows a. In this embodiment it is thus possible to eliminate the necessity of a separate motor for driving the recirculation pump.

Figure 3:
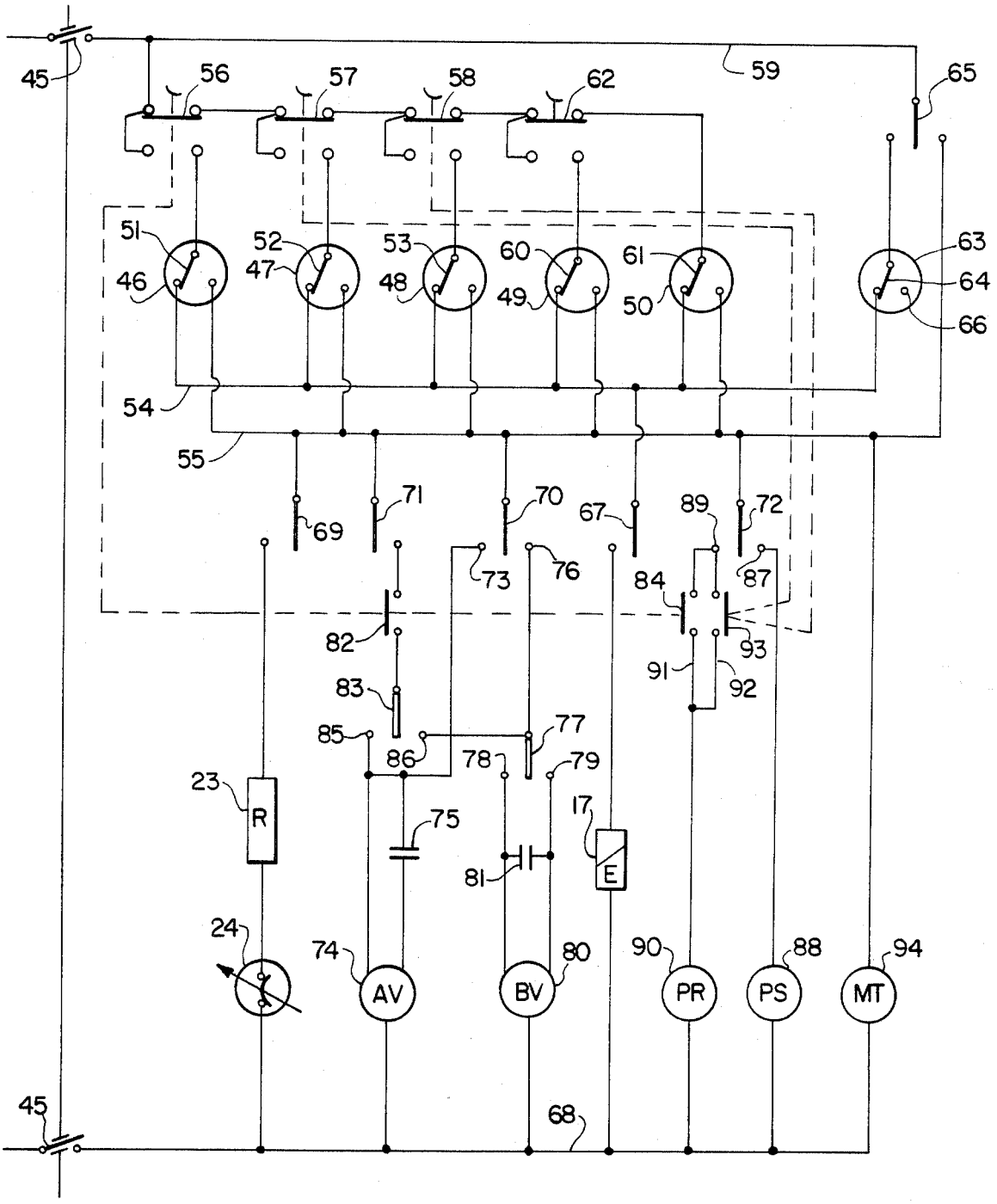
FIG. 3 is an electric circuit diagram of a laundry washing machine according to the invention.

With reference now to FIG. 3, there is shown an electric circuit of the machine and which is connected to a main electric circuit via a main switch 45 and includes a first group of pressure sensors or similar level sensing devices formed by three pressostats or sensors 46, 47 and 48 adapted to control the washing liquid level during "intense" or "heavy" laundering programs for washing not too heavily soiled cotton fabrics of synthetic fabrics resistant to elevated temperatures, and a second group of pressure sensors or similar level sensing devices, shown here as comprising two pressostats or sensors 49 and 50 for controlling the washing liquid level during "intense" laundering programs for washing heavily soiled cotton fabrics or synthetic fabrics resistant to elevated temperatures. Such pressostats or sensors advantageously may be replaced by a smaller number of pef se known pressostats each of which is capable of being calibrated to different water levels in the tub. In particular, the pressostats or sensors 46, 47 and 48 of the first group are calibrated to control the washing liquid charge in tub 6 at different levels so as to ensure efficient laundering of different sized charges of laundry loaded into the drum. In a specific example according to the invention, the drum may be selectively loaded with a maximum charge of laundry, with half the maximum charge or with a quarter of the maximum charge, charges of intermediate magnitude also being possible within the scope of the invention.

The described pressostats or sensors are effective to control the admission of reduced volumes of water into the tub compared to the amount of water admitted to the tub of a conventional laundry washing machine for carrying out an "intense" or "heavy" laundering program. In contrast to the conventional "intense" laundering programs, the reduction of the amount of washing liquid admitted to the tub is made possible by repeatedly recirculating the liquid from collector 21 to tub 6 (FIG. 1) by actuating recirculation pump 26 during predetermined phases of the operating cycle as will be described.

The pressostats or sensors 49 and 50 of the second group likewise are calibrated to control the amount of water admitted to the tub at different levels depending on the amount of laundry loaded into the drum. In the particular example described above, the invention provides the possibility of loading the drum with a full charge or a half charge of laundry, charges of intermediate magnitude being also possible within the scope of the invention. In these cases, the pressostats or sensors are effective to admit the same volumes of water to the washing tub as required for carrying out the respective "intense" laundering programs in conventional laundry washing machines. Each of these laundering programs is otherwise carried out in the conventional manner, i.e. without actuating the recirculation pump.

The sensors 46, 47 and 48 of the first group are provided with respective electric contacts 51, 52 and 53 adapted to be switched from the positions shown in FIG. 3 and corresponding to a "zero" level of washing liquid within the tub, in which case all of the described contacts are electrically connected to a common conductor 54, to operative positions corresponding to respective filling levels of the washing liquid in the tub, in which each of the described contacts is electrically connected to a common conductor 55. The described contacts are additionally associated with respective manually operable switches 56, 57 and 58 adapted to be switched from first positions shown in FIG. 3, at which all of the described switches are electrically connected in series with one another to main switch 45 through a supply conductor 59, to second positions at which each of the described switches is electrically connected to the contact of the associated pressostat 46, 47 or 48, respectively.

In an analogous manner, the sensors 49 and 50 of the second group are provided with respective electric contacts 60, 61 adapted to be switched between operative positions corresponding to the ones described above so as to be electrically connected to conductor 54 or conductor 55, respectively. In this case, however, only sensor 49 is associated with a switch 62 adapted to be switched from a first position shown in FIG. 3, at which it is electrically connected in series to the preceding switch 58 when the latter is in its position shown in FIG. 3, to a second position at which it is electrically connected to the contact 60 of the associated sensor. Contact 61 of the remaining sensor 50 is connected in series directly to switch 62 when the latter is in its operative position shown in FIG. 3.

The electric circuit of the machine further includes an additional sensor 63 or similar level sensing device calibrated to a level of the washing liquid in the tub different from that to which the other sensors are calibrated for controlling the washing liquid level during conventional "gentle" washing programs for washing delicate synthetic fabrics and/or woolens. As in the case of conventional laundry washing machines, a movable contact 64 of sensor 63 may be supplied with current from conductor 59 via a switch 65 cooperating with a cam of the program unit of the machine and adapted to be switched to a second operative position in which it is electrically connected to conductor 55 only, movable contact 64 being adapted to be switched between two operative positions in contact respectively with conductor 54 and with a fixed contact 66 of the sensor 63, fixed contact 66 not being connected to any further conductor.

Common conductor 54 is connected, via a further movable contact 67 cooperating with a cam of the program unit of the machine and via the above mentioned solenoid valve 17, to another supply conductor 68 connected to main switch 45. The other common conductor 55 similarly is connected to further movable contacts 69, 70, 71 and 72 cooperating with respective cams of the program unit for energizing and de-energizing the remaining electric components of the machine as described in the following.

In particular, contact 69 is operable to close a circuit including heater element 23 and thermostat sensor 24 in series therewith and connected to supply conductor 68. This electric heater element is dimensioned for the maximum electric potential and may be energized for periods of varying duration under thermostatic control by sensor 24. In the example described, thermostat sensor 24 is of the adjustable type so as to permit the temperature of the washing liquid to be adjusted to various values up to a maximum of about 90° C. It is also within the scope of the present invention to provide a thermostat sensor device formed of a plurality of individual thermostat sensors calibrated to different temperatures and connected parallel to one another, or formed in any other suitable manner.

Movable contact 70 is adapted to be switched to close a fixed contact 73 for connecting supply conductor 68 to a fixed contact 73 for connecting supply conductor 68 to a high-speed winding 74 of motor 14 in a spinning phase associated with a starting capacitor 75 connected in parallel to winding 74, or to close a fixed contact 76 connected to an inverter switch 77. The latter is intermittently acuated by a further cam of the program unit for closing respective contacts 78 and 79 of a low-speed winding 80 of motor 14, winding 80 likewise being provided with a starter capacitor 81 and connected to supply conductor 68. As a result of the operation of inverter switch 77, motor 14 is adapted to rotate in alternating directions at the washing speed.

The respective high-speed and low-speed windings 74 and 80 may also be connected to supply condutor 68 via contact 71, itself adapted to be connected in series to a further switch 82 and a second inverter switch 83 associated with a respective cam of the program unit. In particular, switch 82 is mechanically connected to switch 56 and to a further switch 84, the function of which will be described in the following, so that actuation of switch 56 to one of its operative positions thereof causes switches 82 and 84 to be simultaneously actuated between different positions. Inverter switch 83 is operable to close a fixed contact 85 connected to high-speed winding 74 or a second fixed contact 86 connected to the above mentioned inverter switch 77. In practice, high-speed and low-speed windings 74 and 80, respectively, are energized via contact 70 for carrying out "intense" and "gentle" laundering programs with the normal level of the washing liquid in the tub, and via contact 71 for carrying out "intense" laundering programs with reduced levels of the washing liquid in the tub.

Contact 72 is adapted to close a fixed contact 87 connected to supply conductor 68 in series with the motor 88 of the discharge pump 43, or a second fixed contact 89 connected to conductor 68 in series with the motor 90 of recirculation pump 26 and with two circuit branches 91 and 92 disposed in parallel with each other and including respectively the above mentioned switch 84 and a further switch 93. Switch 93 is mechanically connected to both of the above described switches 57 and 58, so that actuation of either thereof causes switch 93 to be simultaneously actuated between different operative positions thereof.

The electric circuit shown in FIG. 3 further includes a motor 94 of the program unit directly connected between common conductor 55 and supply conductor 68.

The following description is of various laundering programs which the laundry washing machine according to the invention is capable of executing.

For laundering heavily soiled cotton fabrics and/or synthetic fabrics capable of withstanding elevated temperatures, the machine is adjustable to carry out conventional "intense" laundering programs with the possibility of loading the washing drum with a full charge of laundry or one half of a full charge. In the first case the washing program is carried out by filling the tub with washing liquid up to a level determined by controller or sensor 50 which is activated by maintaining switches 56, 57, 58 and 62 in their first operative positions shown in FIG. 3. In the second case, the washing program is carried out by filling the tub with the washing liquid to a reduced level determined by controller or sensor 49 which is activated by maintaining switches 56, 57 and 58 in their first operative positions shown in FIG. 3 and actuating switch 62 to its second operative position. During these laundering programs, the washing liquid is heated to a maximum temperature of about 90° C., and the washing drum is rotated at the washing speed in alternating directions of rotation, and at the spinning speed in only one direction, by energizing the respective windings 80 and 74 of motor 14 only via contact 70 and inverter switch 77. Recirculation pump motor 90 is not energized, as the two switches 84 and 93 remain in their open positions shown in FIG. 3.

In a similar manner, "gentle" laundering programs for washing delicate synthetic fabrics and/or woolens are carried out in the conventional fashion by activating sensor 63 calibrated to a higher level of the washing liquid in the tub than the remaining sensors of the machine.

The described machine additionally is capable of carrying out "intense" laundering programs for washing less heavily soiled cotton fabrics and/or synthetic fabrics capable of withstanding elevated temperatures, employing reduced washing liquid charges in the tub and offering the possibility of loading the drum with a full charge, half a full charge or a quarter of a full charge of laundry. The amounts of water admitted to the tub for each of these "intense" laundering programs are adjusted so as to ensure that the laundry is completely soaked in each case for efficient laundering in a manner to be described. For carrying out these "intense" laundering programs, a selected one of switches 56, 57 or 58 is actuated to its second operative position, the selection of the respective switch depending on the amount of laundry loaded into the drum, and resulting in the activation of the associated controller or sensor 46, 47 or 48, respectively.

In particular, if a full charge of laundry has been loaded into the drum, the respective program is selected by actuating switch 56 for activating sensor 46, while the remaining switches are maintained in their first operative positions shown in FIG. 3. As a result of this operation, the two switches 82 and 84 mechanically connected to switch 56 are likewise actuated to their closed positions. In this manner the respective windings 74 and 80 of motor 14 of the machine are predisposed to be energized solely via contact 71 and inverter switches 83 and 77, while motor 90 of recirculation pump 26 is predisposed to be energized via contact 72 and circuit branch 91. This laundering program is then carried out by heating the washing liquid contained in collector 21 to a maximum temperature of about 90° C. and by rotating the drum at the washing speed in alternating directions of rotation, and at the spinning speed in only one direction, for shorter periods of time than in the case previously described.

During this program, recirculation pump 26 is also continually actuated so as to draw the washing liquid from collector 21 and recirculate it to tub 6 via conduit 28 by spraying it onto the laundry. As a result, the laundry remains always soaked in the washing liquid for the duration of the laundering process and is thereby protected from damage during the rotation of the drum. As the washing liquid is thus recirculated, it is caused to pass through filter 22 which is effective to retain any dirt particles so as to prevent them from soiling the laundry again and from interfering with the operation of heater element 23, recirculation pump 26 and the discharge pump. The filter is subsequently extracted from its seat for cleaning purposes when so required. The laundering of the laundry in the described manner does not provide for the washing liquid to be discharged. Only at the end of the laundering process will the washing liquid be discharged, followed by a number of rinsing operations in the conventional manner.

The "intense" laundering program for washing a one half size charge of laundry is selected by activating sensor 47 through operation of switch 57, while the remaining switches are maintained at their first operative positions shown in FIG. 3. As a result, switch 93 mechanically connected to switch 57 is simultaneously closed. In this manner motor 90 of recirculation pump 26 is predisposed to be energized via contact 72 and circuit branch 92. The respective windings 74 and 80 of motor 14 are predisposed to be energized exclusively via contact 70 and inverter switch 77. This program is then carried out substantially in the same manner as described above.

The "intense" laundering program for washing a quarter of a full charge of laundry is initiated by activating sensor 48 through operation of switch 58 while maintaining the remaining switches in their respective first operative positions shown in FIG. 3. As a result, switch 93 is again actuated to its closed state as in the preceding case. In this manner, motor 90 of recirculation pump 26 and windings 74 and 80 of motor 14 are predisposed to be energized in the manner described above. For the remainder, this program is carried out substantially in the same manner as the preceding programs.

The laundry washing machine according to the invention thus is capable of washing laundry by the application either of conventional "intense" and "gentle" laundering programs or of "intense" laundering programs employing a reduced level of washing liquid in the washing tub. These latter programs particularly permit the consumption of reduced amounts of water, detergents and electric energy in comparison with conventional "intense" laundering programs. The consumption of detergents is additionally limited due to the fact that any amounts of the detergents deposited in collector 21 are completely recuperated during recirculation of the washing liquid to the tub. A further advantage of the described machine resides in the fact that the laundry can always be sterilized, as all of the "intense" laundering programs are carried out by heating the washing liquid to a maximum temperature of about 90° C.

The positioning of the heater element 23 and the thermostat sensor 24 within collector 21 instead of within the washing tub as in conventional machines, permits the washing tub to be made of a plastics material without the necessity of providing safety devices for the heater element.

We claim:

1. A laundry washing machine comprising:

a washing tub;

a drum rotatably mounted in said tub;

a washing liquid collector disposed at a position below said tub and communicating with an outlet thereof;

electric circulation pump means having an inlet and an outlet connected respectively to said collector and to said tub for repeatedly recirculating washing liquid from said collector to said tub;

said electric pump being connected in an electrical circuit including means for heating the washing liquid, means for controlling the filling level of washing liquid into said tub, and means for controlling the temperature to which the washing liquid is heated by said heating means;

said filling level control means comprising a first group and a second group of level control elements calibrated in such a manner that said elements of said first group are effective to establish filling levels that are lower than those established by said elements of said second group; and actuating means for connecting said heating means and said temperature control means in series selectively with said elements of said first group in parallel with said electric recirculation pump means or with said elements of said second group.

2. A laundry washing machine as claimed in claim 1, wherein said actuating means comprise first and second switch means connected respectively with said elements of said first group and said second group, said first switch means are connected with said electric recirculation pump means by respective electric contact means and are movable from a first operative position, in which said first switch means are connected in series with each other and to said second switch means while said contact means maintain said electric pump in a de-energized state, to a second operative position, in which said first switch means are connected in series to the respective said elements of said first group and said electric pump is energized via the respective said contact means.

3. A laundry washing machine as claimed in claim 2, wherein said second switch means is movable from first to second operative positions for selectively activating the respective said elements of said second group.

4. A laundry washing machine as claimed in claim 2, further comprising at least one motor for driving said drum and including respective windings for a high spinning speed and for a low washing speed, the latter said winding being adapted to be intermittently energized for rotation in opposite directions by means of a first inverter switch, and a second inverter switch for energizing said windings and adapted to be connected to said first inverter switch and to be activated through contact means associated with a single one of said first switch means.

5. A laundry washing machine as claimed in claim 4, wherein said motor is operable to drive said recirculation pump means.

6. A laundry washing machine as claimed in claim 1, wherein said heater means and said temperature control means are accommodated in said collector together with at least one filtering element disposed within the recirculation path of the washing liquid.

7. A laundry washing machine as claimed in claim 1, wherein said tub is supported by a substantially cruciform bracket provided with a hub portion for mounting therein a drive shaft of said drum, said hub portion is formed with an interior chamber communicating via a conduit with said outlet of said electric recirculation pump means, and said chamber communicating with the interior of said drum via axially extending bores formed in said shaft and via a number of conduits formed with perforations.

* * * * *